US010357887B2

(12) United States Patent
Mundhra

(10) Patent No.: US 10,357,887 B2
(45) Date of Patent: Jul. 23, 2019

(54) HANDLE WITH LIGHTING EFFECT

(71) Applicant: Siya, Inc., Santa Fe Springs, CA (US)

(72) Inventor: Sudhir Mundhra, Cerritos, CA (US)

(73) Assignee: SIYA, INC., Santa Fe Springs, CA (US)

( * ) Notice: Subject to any disclaimer, the term of this patent is extended or adjusted under 35 U.S.C. 154(b) by 188 days.

(21) Appl. No.: 15/287,220

(22) Filed: Oct. 6, 2016

(65) Prior Publication Data

US 2018/0099423 A1 Apr. 12, 2018

(51) Int. Cl.
*B26B 1/02* (2006.01)
*B26B 1/10* (2006.01)

(52) U.S. Cl.
CPC . *B26B 1/02* (2013.01); *B26B 1/10* (2013.01)

(58) Field of Classification Search
CPC ..... B26B 1/02; B26B 1/10; B26B 11/008
See application file for complete search history.

(56) References Cited

U.S. PATENT DOCUMENTS 5,802,722 A * 9/1998 Maxey ..... B26B 1/046 30/160
2004/0187313 A1* 9/2004 Zirk ..... B26B 1/04 30/123
2013/0079074 A1* 3/2013 Klitsner ..... A63F 9/24 463/7
2013/0130674 A1* 5/2013 De Wind ..... B60Q 1/2619 455/420
2013/0223045 A1* 8/2013 Cammenga ..... B26B 11/008 362/119
2013/0312264 A1* 11/2013 Cohen ..... B26B 21/526 30/34.05

FOREIGN PATENT DOCUMENTS

WO WO-2004069488 A1 * 8/2004

* cited by examiner

*Primary Examiner* — Stephen Choi
(74) *Attorney, Agent, or Firm* — Cislo & Thomas, LLP

(57) ABSTRACT

A handle having illuminating features, such as on a utility tool, the handle having a housing made up of a first housing section and a second housing section that mate with each other to define a cavity, the first housing section having a plurality of slots through which an internally positioned set of LEDs can emit. The second housing section may similarly have a plurality of protrusions and a second set of LEDs to transmit light. Translucent diffusers may be positioned between the LEDs and their respective housing sections. The utility tool may have additional tools that are spring-loaded to facilitate opening the tools and maintaining the tools in a closed configuration.

11 Claims, 9 Drawing Sheets

HANDLE WITH LIGHTING EFFECT

This invention relates to handles with lights embedded within the handles.

BACKGROUND

There are many different types of knives. In particular, pocket knives are very popular for a variety of functions. Pocket knives generally have blades that can be folded into a handle. Some pocket knives can be locked in the open configuration. Though there are many different types of knives which can be used for many different situations, knives with an illuminating feature have not been seen. Illuminating features can have a variety of benefits, particularly, emergency situations.

In addition, it is desirable to have pocket knives that can open easily, but at the same time maintain a closed configuration. Spring activated knives, such as stilettos and switch blades are illegal in some states due to the quick deployment action by activation of a button that releases a lock causing the spring to deploy the blade. Without the spring action, pocket knives experience resistance that prevents the blade from deploying effectively. Small protrusions have been added near the spine of some pocket knives to facilitate opening the blade with the thumb without spring action. Due to the location of the button near the tang, it is difficult to get leverage on the button; thereby only providing minimal facilitation in deploying the pocket knife.

Some pocket knives may be loose at the hinge allowing deployment of the knife to be easier. But that increases the chances that the pocket knife may open inadvertently. Similar problems exist for utility tools, such as multi-tools.

The illuminating effect can also be applied to any handle on any type of tool, instrument, equipment, gadget, device, appliance, and the like. The illuminating effect can be used in emergency situations to be able to locate the handle, to illuminate a particular area, or for entertainment and aesthetic purposes.

For the foregoing reasons there is a need for a handle with illuminating features.

SUMMARY

The present invention is directed towards a handle incorporating a lighting affect that can be utilized for a variety of purposes on a variety of different types of tools, instruments, equipment, gadgets, devices, appliances, and the like. For ease of discussion and by way of example only, the present invention will be described in the context of a knife. In some embodiments, the invention of the present application may be a hand-held, utility tool, such as a multi-tool or a knife, such as a folding knife or a fixed-blade knife, that has illuminating capabilities. In some utility tools with folding components, such as folding knife embodiments, the blade or other tools may be spring-loaded to facilitate opening components of the tool as well as keeping components of the tool in the closed configuration. Preferably, the illuminating capabilities of the handle are provided by LEDs mounted on a printed circuit board. The printed circuit board is configured to provide varying illuminating displays. For example, the handle can display lights of different colors, solid lights, blinking lights, and combination thereof.

Preferably, the lights illuminate from the handles. Therefore, the handles comprise a plurality of slots through which the lights can be emitted. To enhance the lighting effect, translucent diffusers may be provided in between the LEDs in the housing of the handle. The LEDs can be powered by a rechargeable battery contained within a battery housing having a charging port to allow the rechargeable battery to be recharged.

The housing may also contain a spring biased against the blade to facilitate opening of blades and other components, as well as keeping the blades and other components in a closed configuration in knife and multi-tool embodiments.

DETAILED DESCRIPTION OF THE INVENTION

Figure 1:
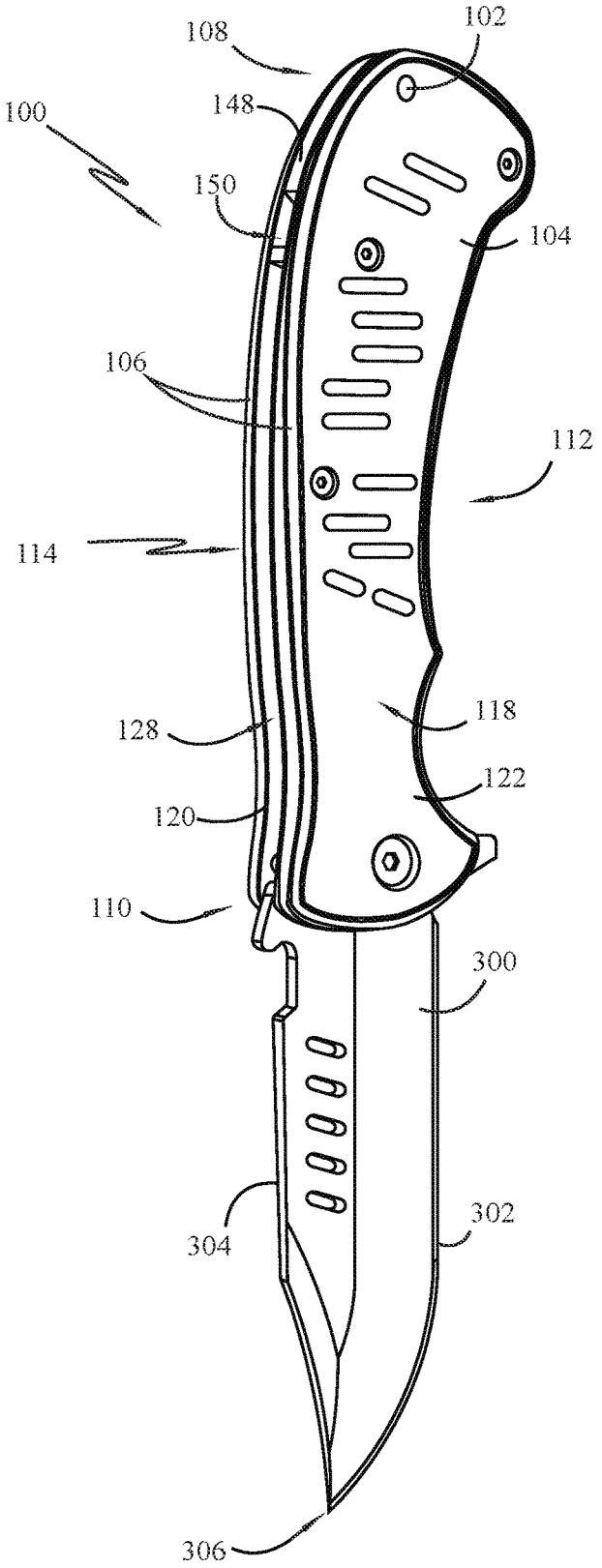
FIG. 1 shows a perspective view of an embodiment of the handle as applied to a knife in the open or deployed configuration.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The present invention is directed towards a handle having lighting effects. In particular, the handle comprises a plurality of slots through which lights mounted inside the handle can be emitted, preferably through a diffuser. Described herein is an example of a handle with the lighting effect as applied to a utility tool, such as a hand-held tool. In the preferred embodiment, the utility tool is a knife 100. The following description will be with respect to the handle 104 as applied to a knife 100, but the handle 104 of the present invention can be applied to other utility tools, such as pocket knives with additional tools, multi-tools, and the like, as well as many other tools, instruments, equipment, gadgets, devices, appliances, and the like, having handles.

With reference to FIGS. 1-4, and 8-9 the handle 104 comprises a housing 106 having a proximal end 108 and a distal end 110, a front side 112, a back side 114 opposite the front side 112, a first lateral side 116 (FIG. 4) adjacent to the front side 112 and the back side 114, and a second lateral 118 side opposite the first lateral side 116 and adjacent to the front side 112 and the back side 114.

The housing 106 comprises a first housing section 120 defining the first lateral side 116 and a second housing section 122 defining the second lateral side 118. The first housing section 120 and the second housing section 122 mate with each at their respective interior sides 124, 126 to define a cavity 128. In folding knives, when the blade 300 is folded into the handle 104, a substantial portion of the blade 300, resides in the cavity 128 with the cutting edge 302 hidden and the spine 304 exposed. In fixed-blade knives, the cavity 128 houses the tang 308.

Figure 4:
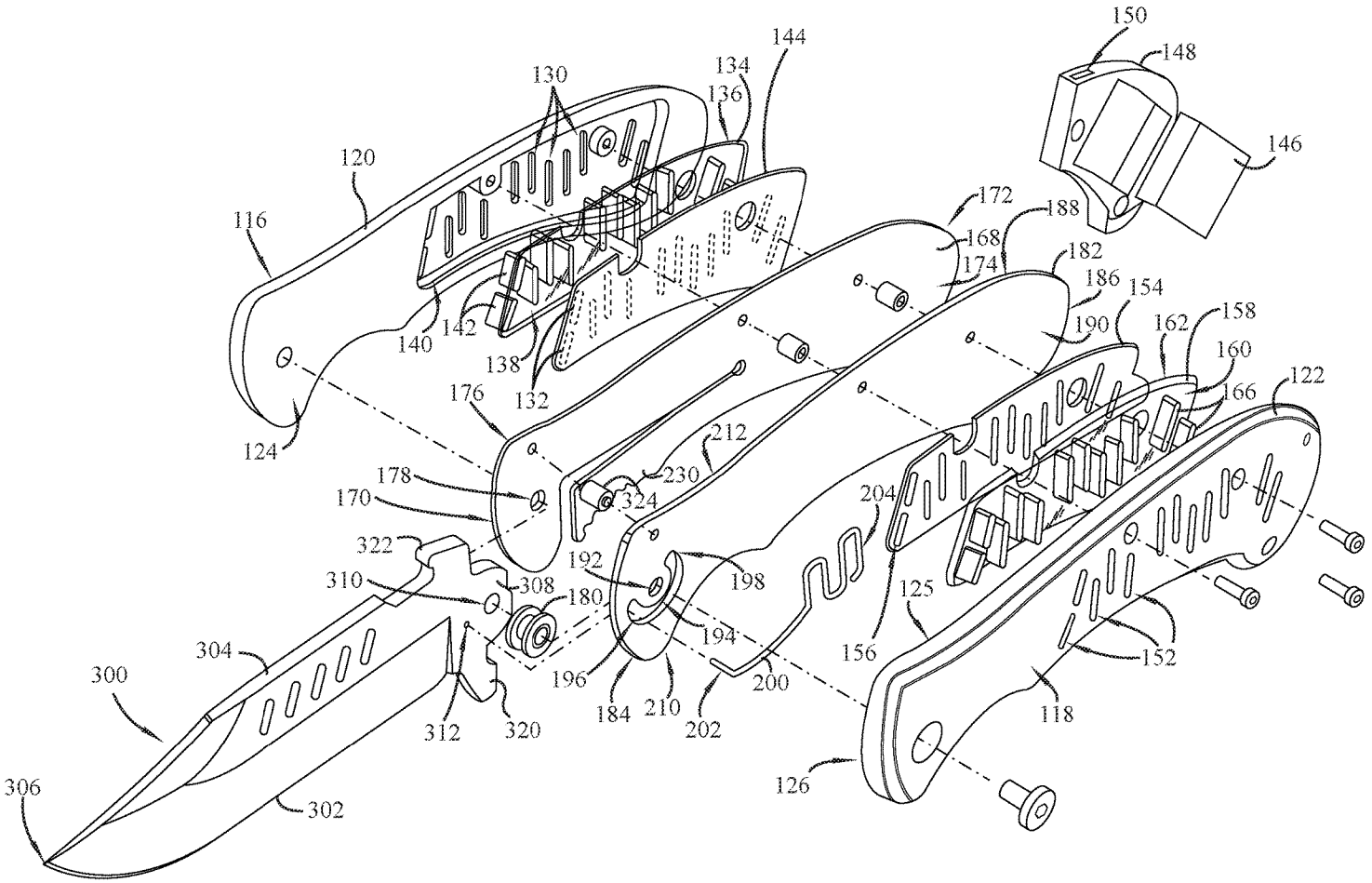
FIG. 4 shows an exploded view of an embodiment of the present invention.
Figure 9:
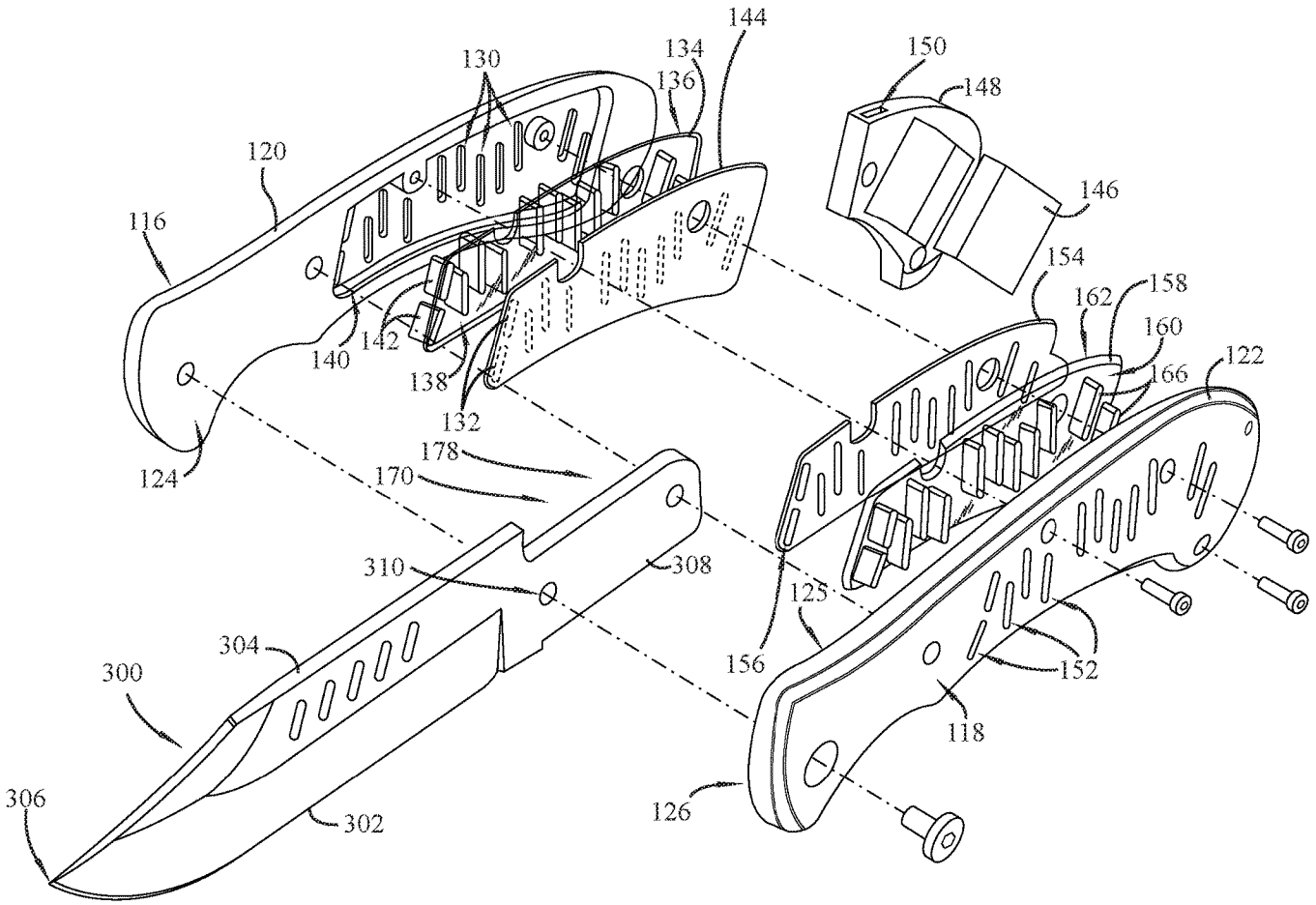
FIG. 9 shows an exploded view of the embodiment shown in FIG. 8.

With reference to FIGS. 4 and 9, the first housing section 120 comprises a plurality of slots 130. A first set of LEDs 132 may be positioned adjacent to the first housing section 120 on the interior side 124 to emit light through the plurality of slots 130 on the first housing section 120. In the preferred embodiment, the handle 104 further comprises a first translucent diffuser 134 positioned in between the first housing section 120 and the first set of LEDs 132. The first translucent diffuser 134 comprises an exterior side 136 and an interior side 138 opposite the exterior side 136. The exterior side 136 of the first translucent diffuser 134 is adjacent to the interior side 124 of the first housing section 120, and the interior side 138 of the first translucent diffuser 134 is adjacent to the first set of LEDs 132. In some embodiments, the interior side 124 of the first housing section 120 may comprise a recessed section 140 sized and dimensioned to receive the first translucent diffuser 134.

Figure 2:
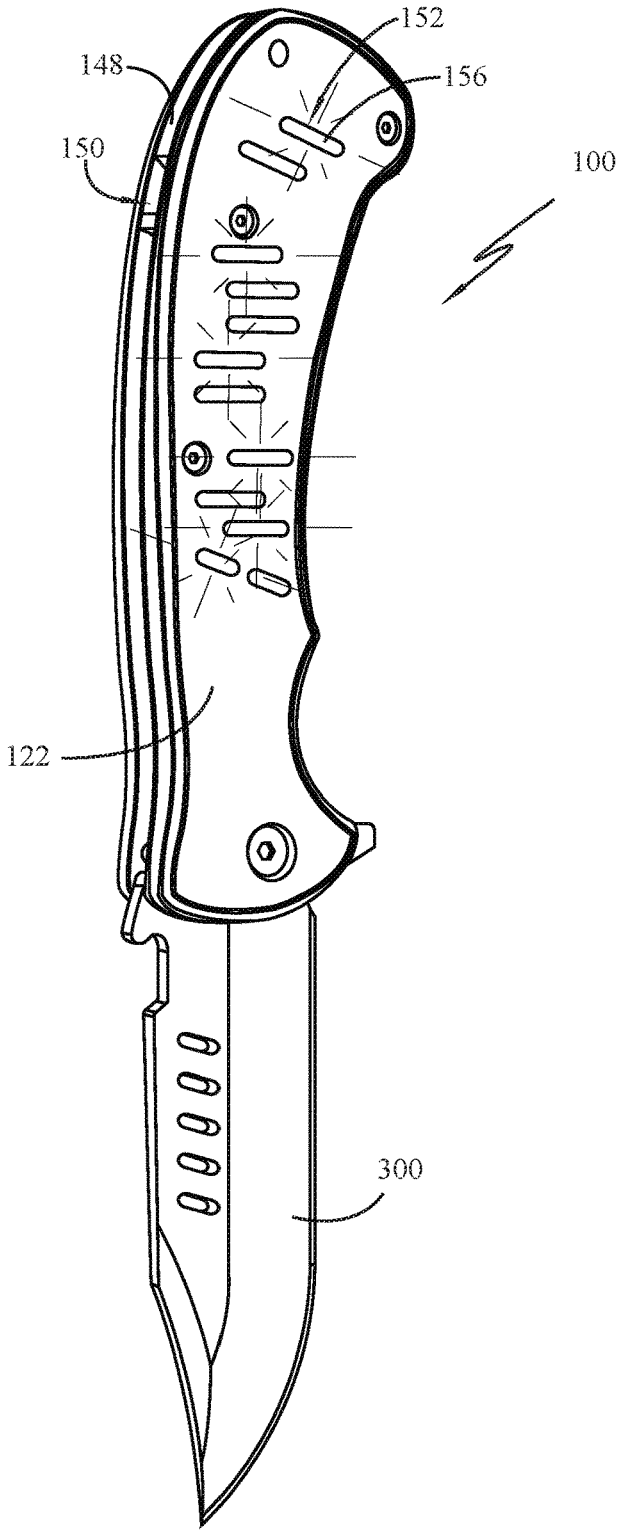
FIG. 2 shows the handle in FIG. 1 with one light displaying characteristic.
Figure 3:
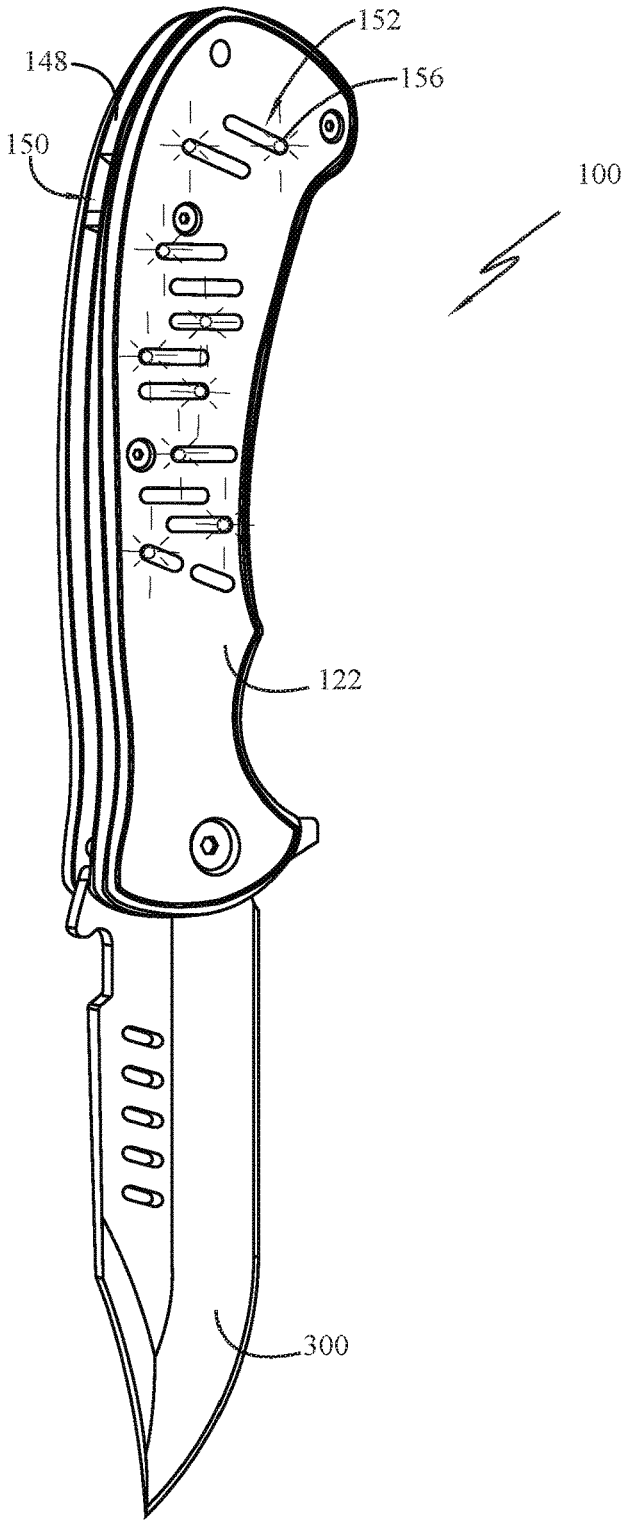
FIG. 3 shows the handle in FIG. 1 with another light displaying characteristic.
Figure 8:
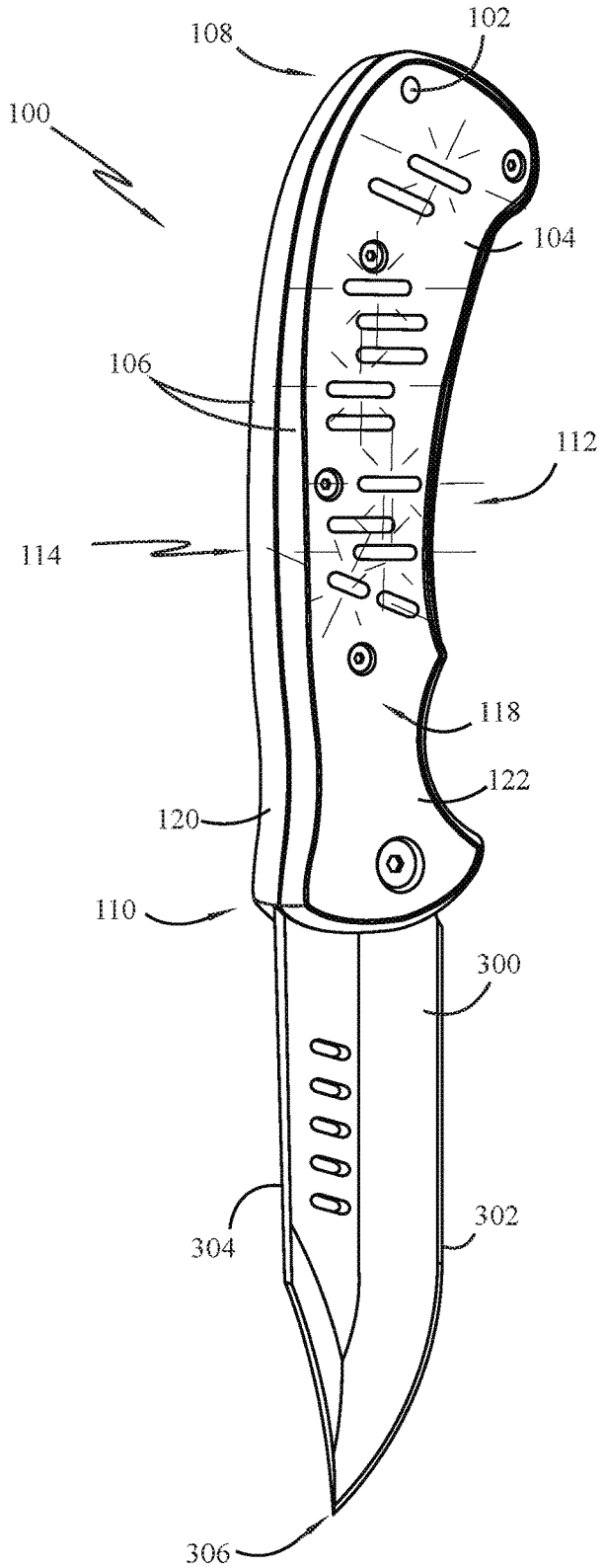
FIG. 8 shows a perspective view of another embodiment of the present invention.

In the preferred embodiment, the first translucent diffuser 134 comprises a plurality of protrusions 142 projecting perpendicularly from the exterior side 136 of the first translucent diffuser 134 towards the first housing section 120. One or more protrusions, and preferably all of the protrusions 142, may correspond with and is shaped substantially similar to one of the slots 130 in the first housing section 120 so that the protrusions 142 of the first translucent diffuser 134 can be inserted into one or more of the slots 130 in the first housing section 120. Preferably, each LED in the first set of LEDs 132 may correspond with one protrusion of the plurality of protrusions 142 so that the first set of LEDs 132 emit light through their respective protrusions 142. However, not all LEDs need to correspond with a protrusion. The first set of LEDs 132 may be operatively connected to a first printed circuit board 144 configured to control the lighting features of the first set of LEDs 132. With reference to FIGS. 2, 3, and 8, the lighting features refer to light displaying characteristics, such as the color, the brightness, the flashing or blinking patterns, and the like. The LEDs in the first set of LEDs 132 may emit one color or may emit multiple colors. Alternatively, the first set of LEDs 132 may comprise different LEDs that emit different colors or have different characteristics. Therefore, the first printed circuit board 144 can be used to control the color of the light being emitted, whether the lights are constantly on or flashing on and off, how bright or dim the lights are, and the like and any combination thereof.

The LEDs 132 are powered by a battery 146 contained within the housing 106 and operatively connected to the first set of LEDs 132. Preferably, a battery housing 148 is provided to contain the battery 146. The battery housing 148 may comprise a charging port 150 so that the battery 146 can be recharged. In the preferred embodiment, the battery housing 148 is positioned at the proximal end 108 of the handle 104.

In the preferred embodiment, the handle 104 has a substantially similar illuminating mechanism on the opposite side 118 so that light can illuminate through the second housing section 122 just like the lights illuminating through the first housing section 120. Therefore, the second housing section 122 may also comprise a plurality of slots 152 through which light can be emitted. Like the first side described above, the second side may comprise a second printed circuit board 154 with a second set of LEDs 156 adjacent to the second housing section 122. The handle 104 may comprise a second translucent diffuser 158 adjacent to the second housing section 122. The second translucent diffuser 158 may comprise an exterior side 160 and an interior side 162 opposite the exterior side 160, with the exterior side 160 of the second translucent diffuser 158 placed adjacent to the interior side 126 of the second housing section 122 and the interior side 162 of the second translucent diffuser 158 placed adjacent to the second printed circuit board 154 and second set of LEDs 156.

In the preferred embodiment, a plurality of protrusions 166 may project perpendicularly from the exterior side 160 of the second translucent diffuser 158 towards the second housing section 122. One or more protrusions 166 on the second translucent diffuser 158 may correspond with and may be shaped substantially similar to one of a plurality of slots 152 in the second housing section 122 so that protrusions 166 of the second translucent diffuser 158 can be inserted into one or more of the slots 152 of the second housing section 122. In addition, the second printed circuit board 154 is placed adjacent to the second translucent diffuser 158 such that each LED of the second set of LEDs 156 corresponds with one of the protrusions 166 of the second translucent diffuser 158. However, in some embodiments, not all of the LEDs need to correspond with a protrusion. The second printed circuit board 154 and second set of LEDs 156 are also operatively connected to the battery 146 for power. In some embodiments the interior side 126 of the second housing section 122 may have a recessed portion 125 to receive the second transcendent diffuser 158.

In embodiments applied to knives and multi-tools, to improve the stability of the knife 100, and particularly, of the blade action, the knife 100 may comprise a blade frame 168, and preferably, two blade frames 168, 182. For ease of description, the blade 300 will considered as occupying generally the center area of the handle 104. Therefore, components positioned laterally away from the blade 300 will be referred to as being lateral or exterior, and components positioned towards the blade 300 will be referred to as being interior or medial.

The first blade frame 168 comprises a first end 170, a second end 172 opposite the first end 170, a first side 174, and a second side 176 opposite the first side 174. The first end 170 of the first blade frame 168 comprises a spindle hole 178. A spindle 180 is mounted in the spindle hole 178 so that the blade 300 can rotate about the spindle 180 to fold into the stowed configuration or deploy into the open configuration.

In the preferred embodiment, a second blade frame 182 is provided. The second blade frame 182 also comprises a first end 184, a second end 186 opposite the first end 184 a first side 188, and a second side 190 opposite the first side 188. Like the first blade frame 168, the second blade 182 frame comprises a spindle hole 192. The spindle 180 can be mounted on the spindle holes 178, 192 of the first and second blade frames 168, 182. The blade 300 is then mounted on the spindle 180 in between the first and second blade frames 168, 182.

Figure 5:
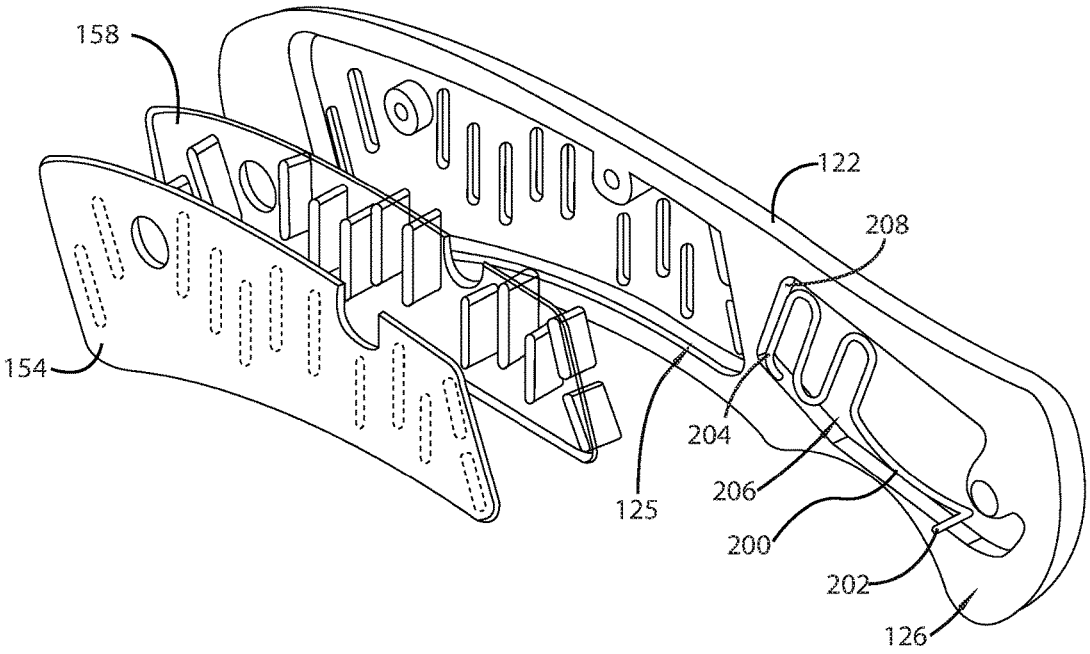
FIG. 5 shows a partially exploded view of one side of a handle of the present invention as applied to a knife.
Figure 6:
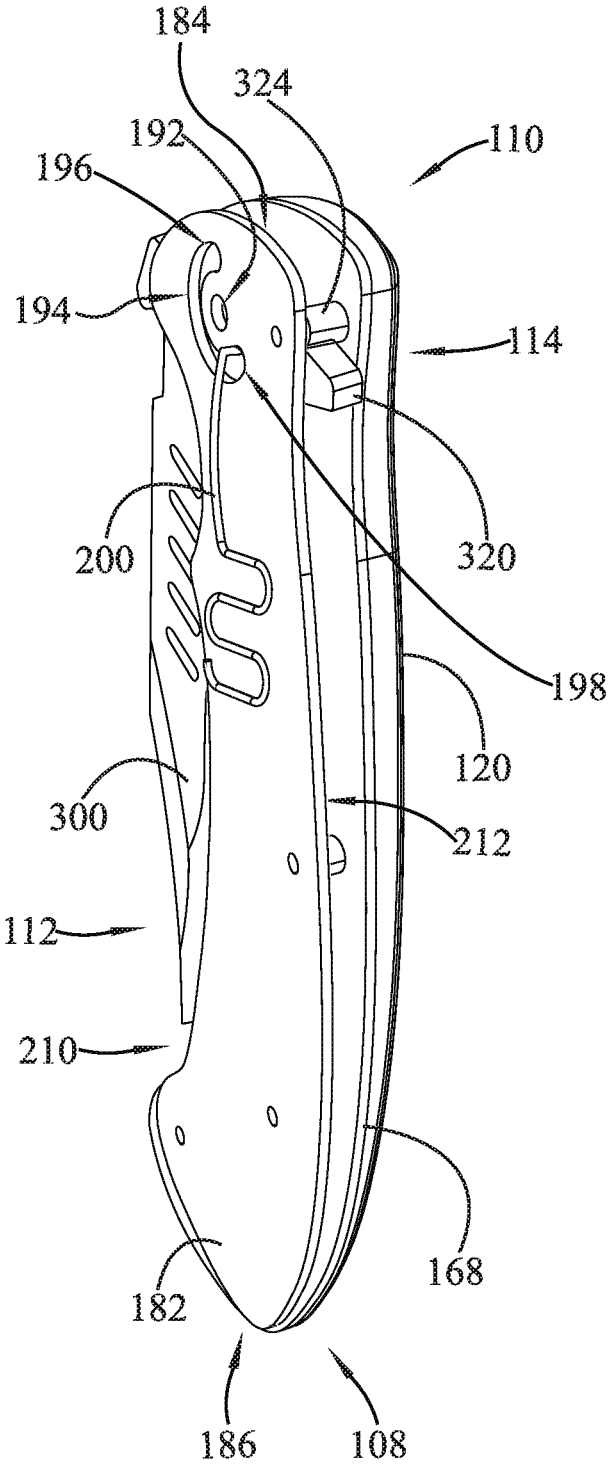
FIG. 6 shows an embodiment of the other side of the handle as applied to a knife in the closed configuration.
Figure 7:
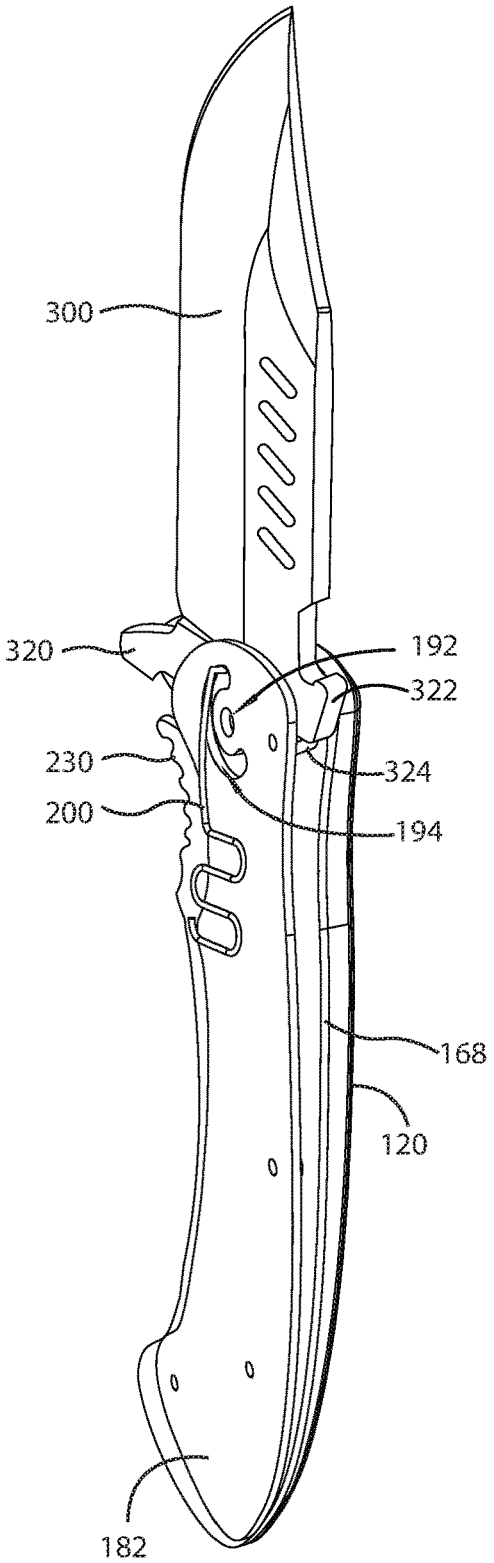
FIG. 7 shows the embodiment in FIG. 6 in the open configuration.

In some embodiments of the folding blades, the first end 184 of the second blade frame 182 comprises a crescent-shaped slot 194. The crescent-shaped slot 194 partially circumscribes the spindle hole 192 and terminates at a top end 196 and a bottom end 198. The crescent-shaped slot 194 provides a guide for the spring action. A spring 200 is located adjacent to the second side 190 of the second blade frame 182. The spring 200 has a first end 202 that is connected to the blade 300 and a second end 204 that abuts against one of the housing sections. In this example, the second end 204 of the spring 200 abuts against the second housing section 122. With reference to FIG. 5, preferably, the second housing section 122 has a recessed portion 206 on the interior surface 126 that creates a ledge 208 against which the second end 204 of the spring 200 abuts. The first end 202 of the spring 200 projects perpendicular to the plane defined by the remainder of the spring 200 and resides in the crescent-shaped slot 194 and is configured to move back and forth between the top end 196 of the crescent-shaped slot 194 and the bottom 98 end of the crescent-shape slot 194 as the blade 300 is deployed and retracted, respectively, as shown in FIGS. 6 and 7. FIGS. 6 and 7 shown the knife 100 with the second housing section 122, the second translucent diffuser 158, and the second printed circuit board 194 removed.

The top end 196 of the crescent-shaped slot 194 terminates above the spindle hole 192 at a location that prevents the first end 202 of the spring 200 from loving any further when the knife is fully deployed or opened. From the top end 196 of the crescent-shaped slot 194, the crescent-shaped slot 194 descends towards the front side 210 of the second blade frame 182, curves towards the second end 186 of the second blade frame 182 them curves towards the back side 212 of the second blade frame 182 and slightly upward back towards the first end 184 of the second blade frame 182. Therefore, when the blade 300 transitions from the fully open configuration towards the stowed configuration, the first end 202 of the spring 200 follows the path of the crescent-shaped slot 194 starting from the top end 196 and terminating at the bottom end 198 of the crescent-shaped slot 194 when the blade 300 is fully closed or stowed. Since the bottom end 198 of the crescent-shaped slot 194 curves slightly upwardly, when the blade 300 is in the closed configuration, the first end 202 of the spring 200 may be biased upwardly against the bottom end 198 of and the crescent-shaped slot 194. This biases the blade 300 to remain in the closed configuration reducing the chances for the blade 300 to deploy unwantedly.

With reference to FIGS. 4 and 9, the blade 300 comprises a cutting edge 302, a spine 304 opposite the cutting edge 302, a tip 306 adjacent to the cutting edge 302 and the spine 304, and a tang 308 opposite the tip 306 and adjacent to the cutting edge 302 and spine 304. The tang 308 connects the blade 300 to the handle 104. To connect the blade 300 to the handle 104 in a moveable manner, the tang 308 comprises a main hole 310. The spindle 180 may be inserted into the main hole 310 about which the blade 300 can rotate relative to the handle 104. In fixed-blade embodiments, the tang 308 may be longer and extend deeper into the cavity for a more stable connection.

To accommodate a spring-assisted blade action, the tang 308 may further comprise an auxiliary hole 312 adjacent to the main hole 310. The first end 202 of the spring 200 can be inserted into the auxiliary hole 312 to facilitate opening of the blade 300 as well as maintaining the blade 300 in the close configuration. Preferably, the auxiliary hole 312 is positioned in between the main hole 310 and the cutting edge 302, so as to align with the crescent-shaped slot 194 in a manner that places the auxiliary hole 312 adjacent to the top end 196 of the crescent-shaped slot 194 when the blade 300 is open, and adjacent to the bottom end 198 of the crescent-shaped slot 194 when the blade 300 is in the closed configuration. The auxiliary hole 312 is also spaced apart from the main hole 310 sufficiently to allow the auxiliary hole 312 to follow the path of the crescent-shaped slot 194.

To prevent over rotation of the blade 300 in either the open configuration or the close configuration, the tang 308 further comprises a forward projection 320 on the cutting edge side projecting away from the cutting edge 302 and a rearward projection 322 on the spine side projecting away from the spine 304. The forward projection 320 and the rearward projection 322 provide a barricade to abut against a stop 324 positioned adjacent to the backside 114 of the handle 104 near the distal end 310. When the blade 300 is rotated into the fully open configuration, the rearward projection 322 abuts against the stop 324 preventing any further rotation of the blade 300 as shown in FIG. 7. When the blade 300 is rotated into the fully closed configuration, the forward projection 320 abuts against the stop 324 preventing any further rotation as shown in FIG. 6.

In the folding knife embodiment, the backside 114 of the housing 106 is open at the distal end 110. In addition, the forward projection 320 is long enough such that when the blade 300 is in the fully closed configuration, the forward projection 320 projects out from the opening on the backside 114 of the housing 106. The forward projection 320 projects out far enough to provide sufficient leverage for the user to be able to depress the forward projection 320 downwardly from the distal end 110 towards the proximal end 108 to cause the blade 300 to move from the close configuration to the open configuration.

Due to the attachment of the spring 200, only a slight motion is required to cause the first end 202 of the spring 200 to move downwardly towards the proximal end 108 and forwardly towards the front side 112 at which point the first end 202 of the spring 200 facilitates movement up the crescent-shaped slot 194 causing the blade 300 to bias towards the open configuration. In the preferred embodiment, the stop 324 is mounted in between the first and second blade frames 168, 182 at the distal end 110 of the housing 106 adjacent to the backside 114 of the housing 106. As the blade reaches its fully open configuration, the rearward projection 322 abuts against the stop 324 preventing over rotation of the blade 300.

The knife may further comprise a lock 230. The lock 230 keeps the blade 300 in the open or deployed configuration. This prevents the blade 300 from inadvertently folding during use. In the preferred embodiment, the first blade 168 frame may comprise a liner lock. The liner lock is a portion of the first blade frame 168 that projects medially so as to be aligned directly underneath the tang 318 of the blade 300 rather than within the plane defined by the remainder of the blade frame 168. In such a configuration, the tang 318 is unable to rotate, keeping the blade 300 in the open configuration. In order to fold or unlock the knife, the liner lock is moved laterally towards the first housing section 120 so as to be offset from the tang 318 and in line with the plane defined by the remainder of the blade frame 168 allowing the tang 318 to rotate to the stowed configuration. In the stowed configuration, the tang 318 is now positioned medially adjacent to the liner lock rather than directly above the liner lock. Although the preferred embodiment is shown with a liner lock other types of locking mechanisms can be used, such as a lockback, frame lock, lever lock, and the like.

The lights can be turned on and off by activating a switch 102 on the handle 104 or by action of the blade 300 or other components (in knife or multi-tool embodiments having a blade or other deployable components).

In some embodiments, the knife 100 may be a folding knife, such as pocket knives, jack knives, utility knives, camping knives, multi-tools, and the like. In some embodiments, the folding knife may have a spring-assisted action to help open the blade 300 when the user wants to deploy the blade 300 and to keep the blade 300 in a stowed configuration when not in use. However, the illumination features in the handle 104 can also be applied to a fixed blade knife, such as hunting knives, tactical knives, Bowie knives, survival knives, machetes, carving knives, throwing knives, and the like.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

For example, although the description was based primarily on a single-bladed knife, the handle 104 and structures within the handle 104 can be applied to other utility tools, such as a Swiss Army knife, a Leatherman tool, and other multi-tools and pocket knives with blade and one or more additional tools, as well as any other tools, instruments, equipment, gadgets, devices, appliances, and the like, having handles. In some embodiments, the handles 104 would have to be larger to accommodate additional tools, such as scissors, screw drivers, can openers, bottle openers, cork screws, nail files, saws, shovels, magnifying glass, flashlight, toothpick, tweezers, wrench, shovel, spoon, fork, and the like. This change in dimension or size would not affect how the illuminating mechanism is arranged within the handle 104 and the slots 130, 152 on the housing 106. In addition, any one or more of the tools can utilize the spring 200 and related features as described above.

What is claimed is:

1. A knife, comprising:

a. a blade comprising a tang and a tip opposite the tang, the tang comprising an auxiliary hole;

b. a handle into which the blade can be movably attached, the handle comprising a housing having a proximal end and a distal end, a front side and a back side, the housing comprising a first housing section and a second housing section that mate with each other to define a cavity, the first and second housing sections each comprising a plurality of slots;

c. a first translucent diffuser adjacent to the first housing section, the first translucent diffuser comprising an exterior side and an interior side opposite the exterior side, and a plurality of protrusions projecting perpendicularly from the exterior side towards the first housing section, wherein each protrusion corresponds with and is shaped substantially similar to one of the slots in the first housing section so that each protrusion of the first translucent diffuser is configured to be inserted into one of the slots in the first housing section;

d. a second translucent diffuser adjacent to the second housing section, the second translucent diffuser comprising an exterior side and an interior side opposite the exterior side, and a plurality of protrusions projecting perpendicularly from the exterior side towards the second housing section, wherein each protrusion corresponds with and is shaped substantially similar to one of the slots in the second housing section so that each protrusion of the second translucent diffuser is configured to be inserted into one of the slots of the second housing section;

e. a first printed circuit board with a first set of LEDs adjacent to the interior side of the first translucent diffuser such that each LED light of the first printed circuit board corresponds with one of the protrusions of the first translucent diffuser;

f. a second printed circuit board with a second set of LEDs adjacent to the interior side of the second translucent diffuser such that each LED light of the second printed circuit board corresponds with one of the protrusions of the second translucent diffuser;

g. a first blade frame positioned adjacent to the first printed circuit board opposite the first translucent diffuser, the first blade frame comprising a lock and a first spindle hole;

h. a second blade frame comprising a first end and, a second end opposite the first end, a first side, and a second side opposite the first side, wherein the first end of the second blade frame comprises a second spindle hole and a crescent-shaped slot partially circumscribing the second spindle hole, the crescent-shaped slot having a top end and a bottom end, and wherein the second side of the second blade frame is positioned adjacent to the second printed circuit board opposite the second translucent diffuser;

i. a rechargeable battery operatively connected to the first and second printed circuit boards;

j. a battery housing contained in the cavity to hold the rechargeable battery, the battery housing comprising a charging port to charge the rechargeable battery;

k. a spindle at the distal end of the housing and attached to the first and second blade frames to which the tang of the blade can rotatably attach at the first and second spindle holes allowing the blade to move in and out of the housing at the front side;

l. a spring having a first end connected to the tang at the auxiliary hole, and a second end abutting against a recessed portion of the second housing section, the spring located adjacent to the second side of the second blade frame with the first end of the spring residing in the crescent-shaped slot and configured to move from the top end of the crescent-shaped slot to the bottom end of the crescent-shape slot as the blade is deployed and retracted; and m. a stop operatively connected to the first and second blade frames, the stop positioned in between the spindle and the back side of the housing.

2. The knife of claim 1, wherein the first set of LEDs emits a first color of light and the second set of LEDs emits a second color of light.

3. The knife of claim 2, further comprising a switch to turn the first and second sets of LEDs on and off, wherein when the first and second sets of LEDs are on, light emitted from the LEDs shine through the respective slots of the respective housing sections.

4. The knife of claim 3, wherein the switch is operatively connected to the first and second printed circuit boards, wherein the first and second printed circuit boards are configured to emit lights with different patterns.

5. A utility tool, comprising:

a. a blade comprising a tang and a tip opposite the tang;

b. a handle attached to the blade, the handle comprising a housing having a proximal end and a distal end, a front side and a back side, a first lateral side adjacent to the proximal end, the distal end, the front side, and the back side, and a second lateral side opposite the first lateral side, and adjacent to the proximal end, the distal end, the front side, and the back side, the housing comprising a first housing section and a second housing section that mate with each other to define a cavity, the first housing section comprising a plurality of slots on the first lateral side;

c. a first set of LEDs positioned to emit light through the plurality of slots on the first housing section;

d. a battery contained within the housing and operatively connected to the first set of LEDs; and e. a first translucent diffuser positioned in between the first housing section and the first set of LEDs, the first translucent diffuser comprising an exterior side and an interior side opposite the exterior side, wherein the exterior side is adjacent to the first housing section, and the interior side is adjacent to the first set of LEDs.

6. The utility tool of claim 5, wherein the first translucent diffuser comprises a plurality of protrusions projecting perpendicularly from the exterior side towards the first housing section, wherein each protrusion corresponds with and is shaped substantially similar to one of the slots in the first housing section so that each protrusion of the first translucent diffuser is configured to be inserted into one of the slots in the first housing section.

7. The utility tool of claim 6, wherein at least some of the LEDs in the first set of LEDs corresponds with one of the protrusions of the plurality of protrusions so that the first set of LEDs emit light through their respective protrusions.

8. The utility tool of claim 7, wherein the LEDs are operatively connected to a first printed circuit board configured to control lighting features of the first set of LEDs.

9. The utility tool of claim 8, further comprising:

a. a second translucent diffuser adjacent to the second housing section, the second translucent diffuser comprising an exterior side and an interior side opposite the exterior side, and a plurality of protrusions projecting perpendicularly from the exterior side towards the second housing section, wherein each protrusion corresponds with and is shaped substantially similar to one of a plurality of slots in the second housing section so that each protrusion of the second translucent diffuser is configured to be inserted into one of the slots of the second housing section;

b. a second printed circuit board with a second set of LEDs adjacent to the interior side of the second translucent diffuser such that at least some of the LEDs of the second printed circuit board corresponds with one of the protrusions of the second translucent diffuser.

10. The utility tool of claim 9, wherein the blade is movably connected to the handle, the utility tool further comprising a spring having a first end connected to an auxiliary hole in the tang, and a second end abutting against one of the housing sections.

11. The utility tool of claim 10, further comprising a blade frame comprising a first end and, a second end opposite the first end, a first side, and a second side opposite the first side, wherein the first end of the blade frame comprises a crescent-shaped slot, the crescent-shaped slot having a top end and a bottom end, wherein the spring is located adjacent to the second side of the blade frame with the first end of the spring residing in the crescent-shaped slot configured to move back and forth between the top end of the crescent-shaped slot and the bottom end of the crescent-shape slot as the blade is deployed and retracted.

* * * * *